US005339759A

United States Patent [19]

Peabody

[11] Patent Number: 5,339,759

[45] Date of Patent: Aug. 23, 1994

[54] BOAT HATCH WIND SCOOP SYSTEM

[76] Inventor: Andrew L. Peabody, P.O. Box 2120, Natchez, Miss. 39121

[21] Appl. No.: 163,512

[22] Filed: Dec. 9, 1993

[51] Int. Cl.[5] ..... B63B 19/06

[52] U.S. Cl. ..... 114/211; 454/78; 454/82

[58] Field of Search ..... 114/361, 211, 201 R; 454/78, 82, 254, 275

[56] References Cited

U.S. PATENT DOCUMENTS

| | | | |
|---|---|---|---|
| 2,308,109 | 1/1943 | Rundquist | 114/361 |
| 4,434,740 | 3/1984 | Childs | 114/211 |
| 4,706,593 | 11/1987 | Vail, Jr. | 114/211 |
| 4,759,271 | 7/1988 | Bliemeister | 114/211 X |
| 4,938,123 | 7/1990 | Hilton | 114/211 X |
| 5,003,905 | 4/1991 | Raynor | 114/201 R |
| 5,022,339 | 6/1991 | Baskin | 114/211 |
| 5,161,478 | 11/1992 | Strieb | 114/201 R X |

*Primary Examiner*—Sherman Basinger

*Attorney, Agent, or Firm*—Carroll F. Palmer

[57] ABSTRACT

A ventilator wind scoop system is disclosed for attachment to a boat deck hatch having a hinged hatch cover which opens to uncover the hatch opening whereby the scoop system communicates through such opening with the boat's below deck space. The scoop system has a flexible air entrance unit formed of first and second fabric panels fixed in line contact with each other along their forward edges. The first panel, which is positioned forward and over the front edge of the hatch cover, contains a screened, rectangular opening through which air passes to flow over the top of the second panel that extends under the hatch cover and between two triangular side wedges. The second panel provides a louvre that collects any water entering the screened opening and carries it forward, away from the hatch opening. The wind scoop system is easily customized to fit a wide variety of hatch sizes and when not is use folds into a compact size for easy stowage.

6 Claims, 3 Drawing Sheets

BOAT HATCH WIND SCOOP SYSTEM

BACKGROUND OF THE INVENTION

1. Field of the Invention

This application relates to boat hatch wind scoop systems. More particularly, it concerns wind scoops for ventilating below deck space of a boat through a hatch while preventing water from entering through the hatchway.

2. Description of the Prior Art

Ventilation of the below deck space of sailboats, power boats and like marine craft is essential to the comfort of passengers, preservation of stores, prevention of mildew, etc. Larger craft frequently are provided with air conditioning equipment, but smaller craft and even larger sailboats do not enjoy this luxury. Hence, many marine craft must depend on more basic, passive ventilation devices, e.g., dorade boxes, scoop ventilators, hinged hatches, etc.

Many boats with below deck space possess one or more hinged closure hatches opening through the deck and a number of ventilator devices have been devised for deflecting or otherwise facilitating flow of air below deck through such hatches, e.g., see U.S. Pat. Nos. 4,434,740; 4,706,593; 4,759,271; 4,938,123 and 5,022,339. The present invention provides further improved marine craft ventilation systems of this general type.

OBJECTS

A principal object of the invention is the provision of wind scoop systems for ventilating below deck space of a boat through a hatch while preventing water from entering through the hatchway.

Another object is the provision of such wind scoop systems that are capable of being marketed as a universal kit that may be easily customized to conform to the precise dimensions and configuration of the particular boat hatch to which the system is to be applied.

A further object is the provision of such wind scoop systems that can be easily dismantled when not in use and stored in a small size space, e.g., in a locker or under a berth.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished, in part, in accordance with the invention by the provision of wind scoop systems for attachment to a marine craft deck hatch having a hinged hatch cover which opens to uncover the hatch opening whereby the system communicates through the opening with the below deck space of the craft. Basically, the new systems comprise (a) a flexible entrance unit, (b) a pair of rigid triangular wedges, (c) a plurality of fastener tapes, (d) a zipper closure strip, and (e) an elastic cord member. Such components are advantageously marketed as a partially assembled kit for retrofitting to a boat hatch.

The entrance unit is formed of first and second fabric panels, each presenting a front surface and a rear surface. The first panel has a rectangular screened opening centered between its side edges and closer to the bottom edge than the top. The side edges come together slightly at the bottom to form a bottom flap and there is a flap at top of the panel deeper, but narrower than the bottom flap. This top flap has a pocket sewn into its top edge that captures a metal rod to act as a weight.

The second panel is generally rectangular in shape and the zipper closure strip "d" is fastened to its rear surface longitudinally aligned with the top edge of the panel. This closure strip is used to envelop the elastic cord "e" when the scoop system is installed in a boat hatch to hold the second panel angled upwardly so any water that gets through the screened opening will be carried by such panel out of the hatchway.

A second longitudinal pocket is positioned along the bottom edge of the second panel and a metal rod is captured in it to serve as a weight to hold the second panel's bottom edge in position when the system is installed on a boat hatch.

In the entrance unit, the back surface of the first panel is fixed, e.g., by stitching, in line contact to the front surface of the second panel with the straight lower edge of the first panel being parallel and spaced apart a short distance from the straight bottom edge of the second panel.

In use, the wind scoop systems of the invention are attached to a marine craft deck hatch having a deck supported quadrilateral rim to which the hatch cover is hinged and the cover is opened at an angle to uncover the hatch opening whereby the system communicates through the opening with the below deck space of the craft.

One of the of rigid triangular wedges "b" is positioned between the starboard side of the hatch cover and the starboard side of the rim and the other of the of rigid triangular wedges is positioned between the port side of the hatch cover and the port side of the rim.

The elastic cord member "e" is stretched between the triangular wedges, e.g., by fastening its ends through holes in the triangular wedges.

The flexible entrance unit is positioned with the first panel forward of the hatch cover and the triangular wedges while part of the second panel extends beneath the hatch cover and between the triangular wedges with the zippered closure zippered around the elastic cord member forming a louvre portion.

The longitudinal pocket on the first panel is folded back over the forward edge of the hatch cover and the longitudinal pocket on the bottom of the second panel is folded down over the forward edge of the hatch rim.

The fastener tapes "c", which advantageously have a hook/loop type front and an adhesive back, sold commercially as Velcro ®, are used to hold the sides of the first panel against the forward ends of the triangular wedges.

With a wind scoop system of the invention installed in a boat hatch as described, air will flow through the screened opening in the entrance unit, over the top surface of the second panel and down the hatchway into the below deck space of the boat. Water that may pass through the screened opening will fall onto the louvre surface of the second panel and flow by gravity down such surface to exit openings on either the starboard or port sides of the scoop system existing between the first and second panels of the entrance unit.

BRIEF DESCRIPTION OF THE DRAWINGS

A more complete understanding of the invention can be obtained by reference to the accompanying drawings in which.

DESCRIPTION OF THE PREFERRED EMBODIMENTS

Figure 1:
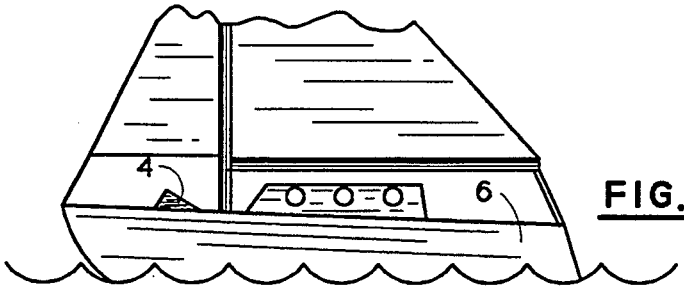
FIG. 1 is a lateral, fragmented view of a sailboat equipped with a wind scoop system of the invention.
Figure 2:
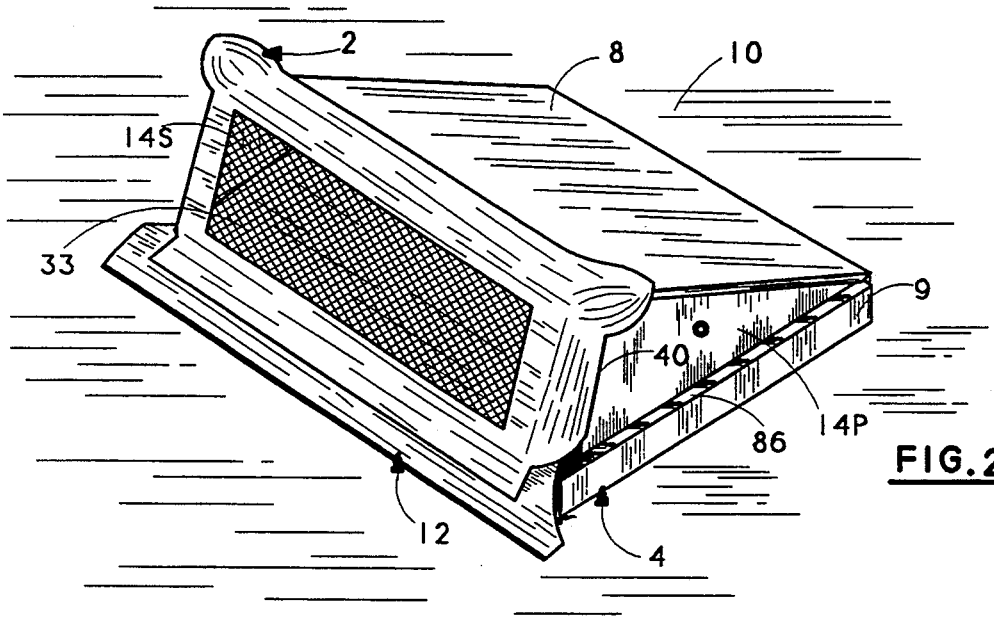
FIG. 2 is an isometric view of a wind scoop system of the invention installed on the forward deck hatch of sailboat of FIG. 1.
Figure 3:
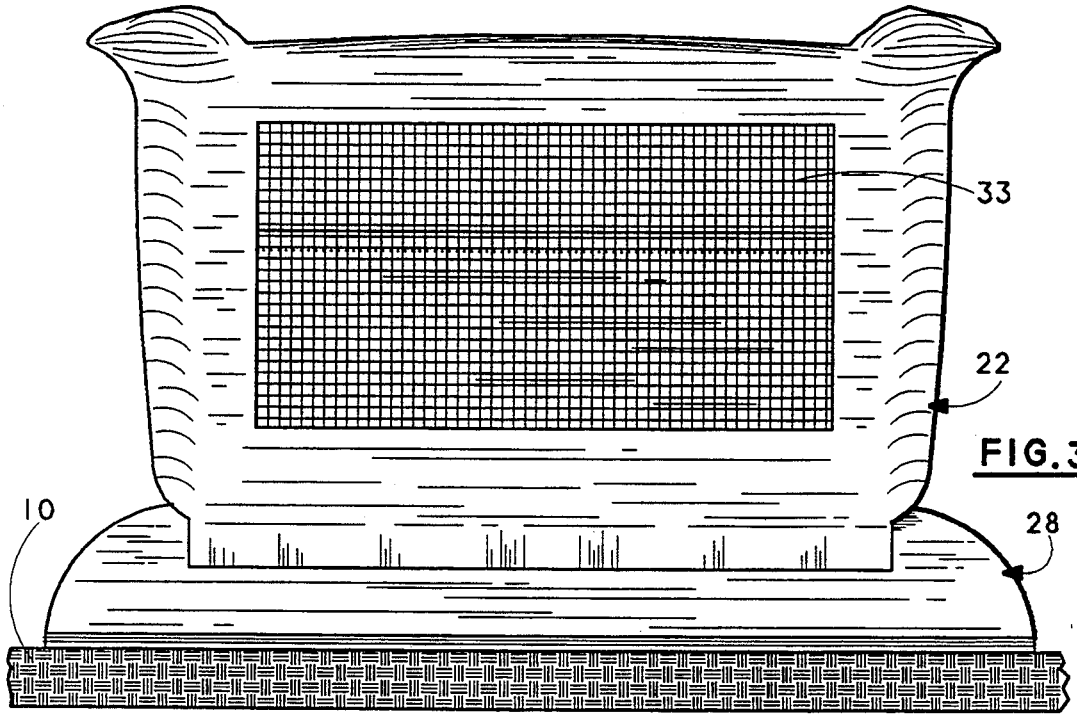
FIG. 3 is a fragmentary front end view of the wind scoop system of FIG. 2.

Referring in detail to the drawings, the wind scoop system 2 of the invention is attached to deck hatch 4 of sailboat 6 that has hinged hatch cover 8 which opens to uncover the hatch opening, defined by a quadrilateral rim 9 to which the hatch cover 8 is hinged, so the system 2 communicates through such opening with the space (not shown) below the deck 10 of the sailboat 6.

System 2 basically comprises a flexible entrance unit 12, starboard and port rigid triangular wedges 14S & 14P respectively, a plurality of fastener tapes 16, a zipper closure strip 18, and an elastic cord member 20.

The entrance unit 12 comprises first fabric panel 22 presenting a front surface 24, a rear surface 216 plus a screened rectangular opening 33 and a second fabric panel 28 presenting a front surface 30 and a rear surface 32.

The first panel 22 has an upper edge 34, a straight lower edge 36, a first side edge 38 and a second side edge 40. The upper edge 34 is defined by a minor left segment 42, a mirror image right segment 44, a major central segment 46 and a pair of parallel, perpendicular segments 48 while the side edges each have a major upper segment 50 and a minor lower segment 52.

The second panel 28 has a top edge 54, a straight bottom edge 56, a straight third side edge 58 and a straight fourth side edge 60. The top edge 54 is defined by a major central portion 62 parallel to the bottom edge 56, a left portion 64 angled relative to the central portion 62 and a mirror image right portion 66.

Typically, the fabric panels 22 & 28 are made of woven polyester filaments and the rigid triangular wedges 14S & 14P are cut from sheets of rigid polyethylene or equivalent rigid plastic.

The zipper closure strip 18 has a length about equal to the major central portion 62 and .is fastened to the rear surface 32 of second panel 28 longitudinally aligned with the major central portion 62.

Figure 8:
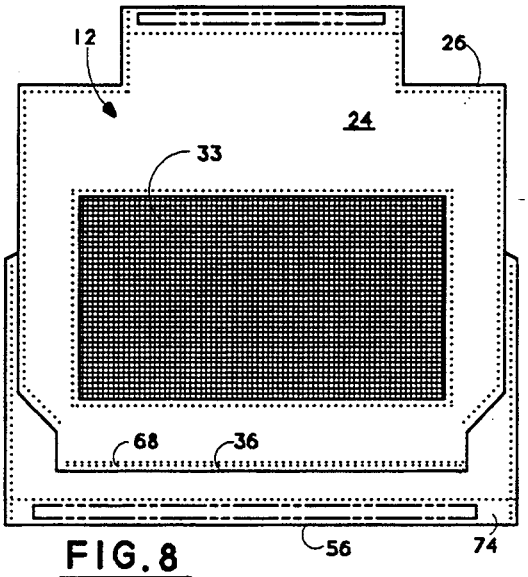
FIG. 8 is a obverse view of the first and second components stitched together.
Figure 7:
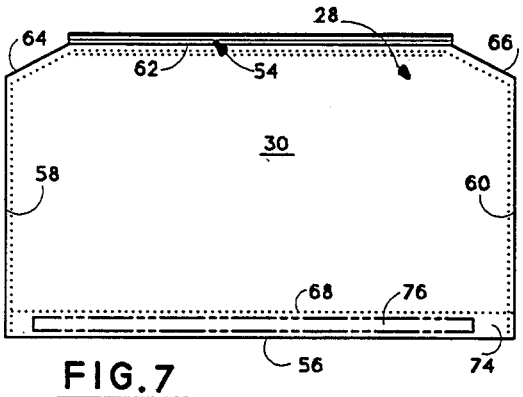
FIG. 7 is a obverse view of a second component of the wind scoop system of FIG. 2.
Figure 9:
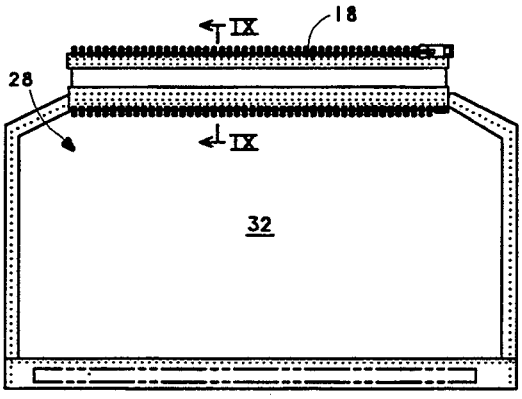
FIG. 9 is a reverse view of the second component.
Figure 10:
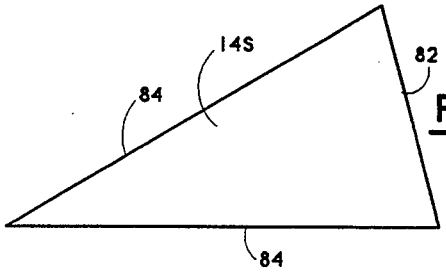
FIG. 10 is a plan view of one of two rigid panel members of the wind scoop system of FIG. 2.
Figure 11:
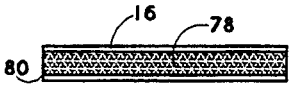
FIG. 11 is a plan view of one of several hook/loop type fastener tapes of the wind scoop system of FIG. 2.
Figure 13:
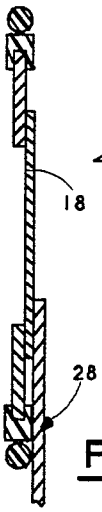
FIG. 13 is an enlarged, fragmentary, sectional view taken on the line IX—IX of FIG. 9.
Figure 12:
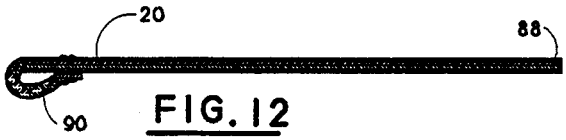
FIG. 12 is a plan view of an elastic member component of the wind scoop system of FIG. 2.
Figure 14:
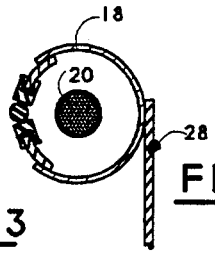
FIG. 14 is a fragmentary, sectional view similar to FIG. 13, but showing the closure strip of the wind scoop system zippered closed.

As seen in FIG. 8, the back surface 26 of the first panel 22 is fixed in line contact to the front surface: 30 of the second panel 28, such as by stitching 68 with the straight lower edge 36 of first panel 22 parallel and spaced apart a short distance from the straight bottom edge 56 of the second panel 28.

A first longitudinal pocket 70 is formed by stitching 68 along the major central segment 46 of the upper edge 34 of the first panel 22 and a metal rod 72 is captured in the first pocket 70.

A second longitudinal pocket 74 is formed by stitching 68 along the bottom edge 36 of second panel 28 and a metal rod 76 is captured therein.

The fastener tapes 16 comprise a hook/loop type front 78 and an pressure-sensitive adhesive back 80, initially overlaid with a protective release strip.

The wind scoop systems 2 of the invention are readily customized to properly fit the particular hatch 4 of any boat, e.g., the sailboat 6. This is an important feature since there are numerous different hatches available for use in construction of boats. Typical hatches for installation of the new wind scoop systems will measure from about 18"×18" to 25"×24".

To begin an installation, the wedges 14S & 14P are placed on both sides of the hatch 4 with the hatch cover 8 in a full open position. With the bases 82 of the wedges forward and one of their sides 84 in contact with the upper ledge 86 of rim 9, the cover 8 is lowered until it touches the upper sides 84 of the wedges 14S & 14P which should be pressed smoothly against the outside of the rubber seals (not shown) of the hatch at the top and rim at the bottom. The bases 82 of the wedges should not protrude past the front edge of the rim 9.

Next, the entrance unit 12 is placed over the hatch 4 with the pocket 70 and rod 72 lapped back over the forward edge of the cover 8 and the pocket 74 and rod 76 resting on the deck 10 in front of the hatch 4. Then, the upper panel 22 is drawn around the hatch 4 so its side edges 38 & 40 are tightened over the bases 82 and against the outsides of the wedges 14S & 14P.

After it is seen how the edges 38 & 40 fit snugly against the wedges, press the hook/loop surfaces 78 of two tapes 16 are pressed together and repeat with two other tapes to obtain a pair of intrameshed tapes each with adhesive surfaces 80 outward. The protective coverings are then removed so the two adhesive surfaces 80 of the intrameshed strip pairs are exposed.

Now, one adhesive surface of one tape pair is pressed against the surface 26 of panel 22 along edge 38 and then the other adhesive surface of such tape pair is pressed against the outside surface of wedge 14S along its base 82. This operation is repeated so the second tape pair is adhesively positioned on edge 40 of panel 22 and along the base 82 of wedge 14P. The resulting adhesive fastening of the tapes 16 to the wedges 14S and 14P can be later strengthened, if desired, with SS screws and washers.

Figure 4:
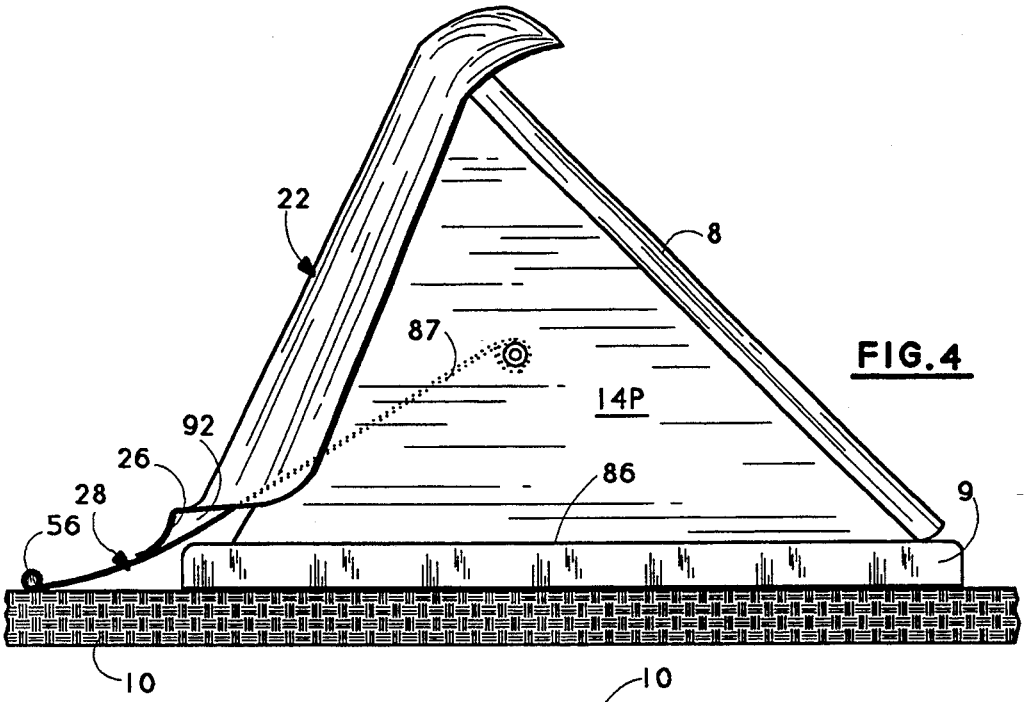
FIG. 4 is a fragmentary lateral view of the wind scoop system of FIG. 2.
Figure 5:
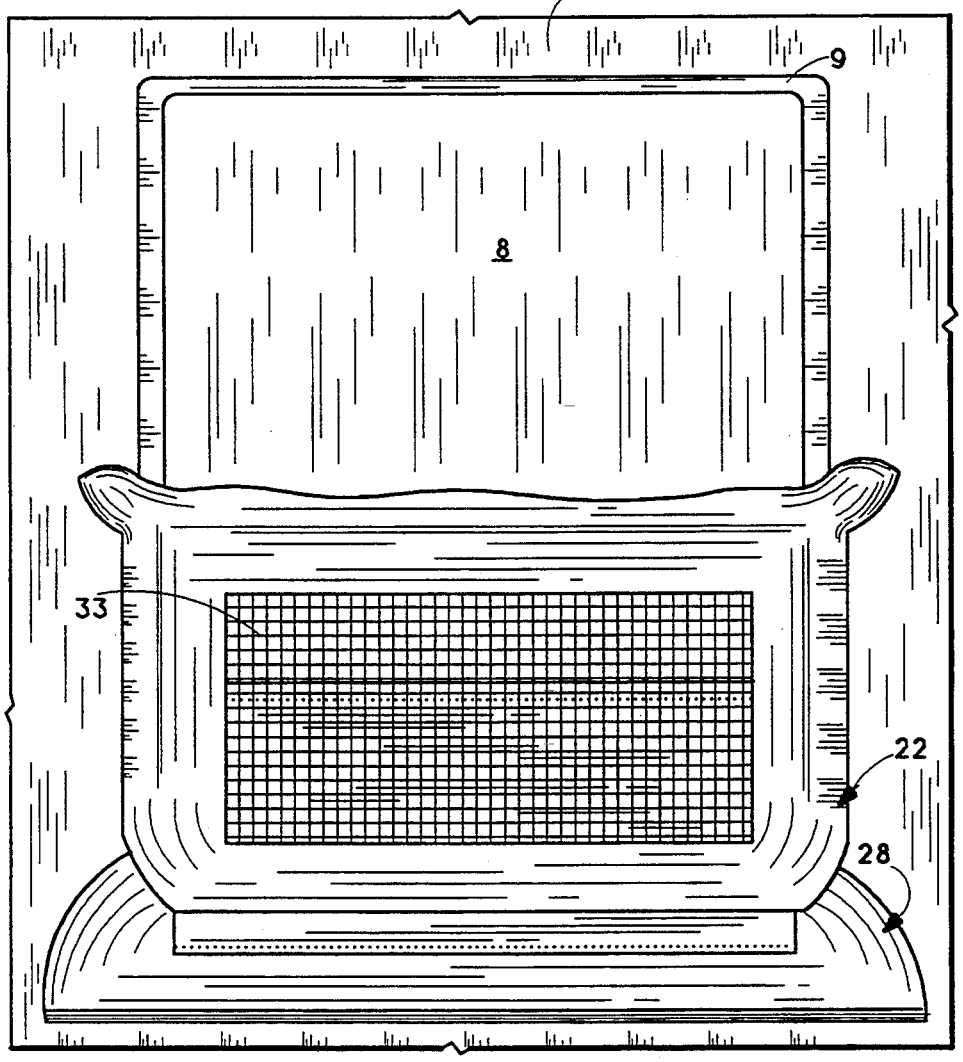
FIG. 5 is a fragmentary plan view of the wind scoop system of FIG. 2.
Figure 6:
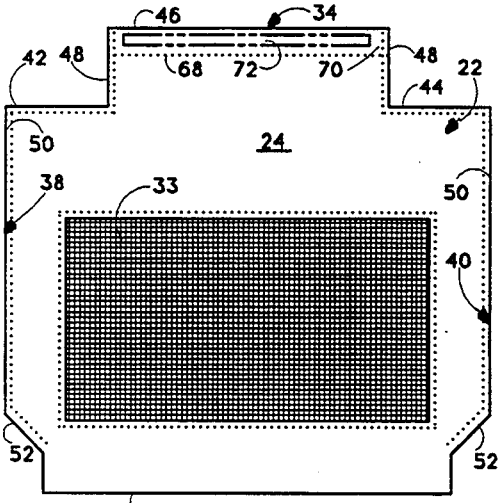
FIG. 6 is a obverse view of a first component of the wind scoop system of FIG. 2.

As the next installation step, one goes below deck and with a marker to make marks on the inside surface on each of the wedges 14S & 14P for a hole to receive the shock cord or like elastic member 20. This cord will exert a steady pressure against the wedges to hold them securely against the hatch cover 8. Also, the zipper closure strip 18 will be zippered closed around the cord 20 as shown in FIG. 4 to form a louver 87 Out of the rear portion of panel 28. This louver 87 should be positioned at about a 20° angle up and back relative to the deck 10.

With the panel 28 elevated as indicated in FIG. 4, a spot is marked on wedge 14S were the zipper strip 18 ends. Next a second mark is made on a one inch extension of the longitudinal line of the louver 87. This is the spot that is drilled to receive an end of cord 20. The same procedure is performed to make a drill mark on wedge 14P. The wedges are then removed from the hatch and drilled at the marked spots for the ends of cord 20.

The drilled wedges are next replaced in position on the hatch 4 as shown in FIG. 4. The unfinished end 88 of cord 20 is inserted from the outside through the drilled hole in wedge 14S (or 14P) and then from the inside through the drilled hole in wedge 14P (or 14S) and pulled until a reasonable stretch has occurred to properly hold the wedges against the sides of the cover 8. With the cord 20 so stretched, any excess beyond 2 inches is cut off and such end is then finished by clamping on a hog ring, by wrapping with SS wire or in other suitable fashion.

To complete installation, the hatch cover 8 is secured onto the wedges 14S & 14P by tightening the hatch locking mechanism, the pocket 70 is again lapped over the front of cover 8 and the edges 38 & 40 of panel 22 are refastened to the base portions 82 of the wedges via the installed hook/loop strips 16.

The wind scoop system of the invention is now in place on the boat 6. With the boat at anchor, it will normally face the wind and air will flow through the screened opening 27, over louver 86 and down into the below deck space of the boat 6. If rain or spray occurs, the hatch 4 can remain open for ventilation and any water coming through the screen will drop onto the louver to flow down and out through the starboard and port side openings 92 between panels 22 and 30.

To dissemble the wind scoop system 2, one need only lift the hatch cover 8, after release of the locking mechanism (not shown) and then withdraw the wedges 4S & 14P plus flexible entrance unit 12 from the hatch 4. The removed system 2 then compactly folds up for convenient storage in a locker or beneath a berth.

The embodiments of the invention in which an exclusive property or privilege is claimed are defined as follows:

1. A wind scoop system for attachment to a marine craft deck hatch having a hinged hatch cover which opens to uncover the hatch opening whereby said system communicates through said opening with the below deck space of said craft that comprises:

a flexible entrance unit, a pair of rigid triangular wedges, a plurality of fastener tapes, a zipper closure strip, and an elastic cord member, said entrance unit comprising first and second fabric panels, each presenting a front surface and a rear surface, said first panel being defined by an upper edge, a straight lower edge shorter in length than said upper edge, a first side edge and a second side edge that is the mirror image of said first side edge, wherein:

said upper edge is defined by a minor left segment, a mirror image right segment, a major central segment offset laterally from and parallel to said left and right segments and a pair of parallel segments normal to said left, central and right segments, said side edges each defined by a major upper segment, a minor lower segment parallel and indented relative to said upper segment and an angled segment joining said upper segment to said lower segment, and a screened rectangular opening in said first panel, said second panel being defined by a top edge, a straight bottom edge, a straight third side edge and a straight fourth side edge that is the mirror image of said third side edge, said top edge defined by a major central portion parallel to said bottom edge, a left portion angled relative to said central portion and a right portion the mirror image of said left portion, and said zipper closure strip having a length about equal to said major central portion and being fastened to said rear surface of second panel longitudinally aligned with said major central portion, said back surface of said first panel being fixed in line contact to said front surface of said second panel with said straight lower edge of said first panel being parallel and spaced apart a short distance from said straight bottom edge of said second panel.

2. The wind scoop system of claim 1 wherein a first longitudinal pocket is positioned along said major central segment of said upper edge of said first panel and a metal rod is captured in said first pocket.

3. The wind scoop system of claim 2 wherein a second longitudinal pocket is positioned along said major central portion of said bottom edge of said second panel and a metal rod is captured in said second pocket.

4. The wind scoop system of claim 3 wherein said fastener tapes comprise a hook/loop fastener type front and an adhesive back.

5. The wind scoop system of claim 4 attached to a marine craft deck hatch having a deck supported quadrilateral rim to which said hatch cover is hinged and said cover is opened at an angle to uncover the hatch opening whereby said system communicates through said opening with the below deck space of said craft, one of said rigid triangular wedges being positioned between the starboard side of said hatch cover and the starboard side of said rim and the other of said of rigid triangular wedges being positioned between the port side of said hatch cover and the port side of said rim, said elastic cord member being stretched between said triangular wedges, said flexible entrance unit being positioned with said first panel forward of said hatch cover and triangular wedges while part of said second panel extends beneath said cover and between said triangular wedges with said zippered closure zippered around said elastic cord member, said first longitudinal pocket being folded back over the forward edge of said hatch cover and said second longitudinal pocket being folded down over the forward edge of said hatch rim.

6. The wind scoop system of claim 5 wherein one of said fastener tapes is fixed to an outboard side and along the forward end of each of said starboard side and port side triangular wedges, other of said fastener tapes are fixed to the rear surface of said first panel adjacent each of said first side edge and second side edge thereof and said fastener tapes are intrahooked to hold said first and second side edges against said forward ends of said triangular wedges.

* * * * *